US007422074B2

(12) United States Patent
Meneghini

(10) Patent No.: US 7,422,074 B2
(45) Date of Patent: Sep. 9, 2008

(54) DELAYED COMPRESSION SLEEVE HAMMER

(75) Inventor: Robert J. Meneghini, Pascoag, RI (US)

(73) Assignee: Numa Tool Company, Thompson, CT (US)

( * ) Notice: Subject to any disclaimer, the term of this patent is extended or adjusted under 35 U.S.C. 154(b) by 0 days.

(21) Appl. No.: 11/437,183

(22) Filed: May 19, 2006

(65) Prior Publication Data

US 2007/0267205 A1 Nov. 22, 2007

(51) Int. Cl.
*B25D 9/18* (2006.01)
*B25D 9/00* (2006.01)
*B25D 17/14* (2006.01)

(52) U.S. Cl. ..... 173/17; 173/13; 173/78

(58) Field of Classification Search ..... 173/13–17, 173/59, 73, 78–79, 80
See application file for complete search history.

(56) References Cited

U.S. PATENT DOCUMENTS 2,786,451 A * 3/1957 Dulaney ..... 173/73
3,154,153 A * 10/1964 Wilder et al. ..... 173/73
3,924,690 A * 12/1975 Shaw ..... 173/13
3,958,645 A * 5/1976 Curington ..... 173/17
4,054,180 A * 10/1977 Bassinger ..... 173/136
4,084,647 A * 4/1978 Lister ..... 173/73
4,194,581 A * 3/1980 Walter ..... 175/92
4,446,929 A * 5/1984 Pillow ..... 173/17
4,637,476 A * 1/1987 Gurkov et al. ..... 173/136
4,819,739 A * 4/1989 Fuller ..... 173/17
5,419,403 A * 5/1995 Klemm ..... 173/115
5,715,897 A * 2/1998 Gustafsson ..... 175/296
5,984,021 A * 11/1999 Pascale ..... 173/90
6,131,672 A * 10/2000 Beccu et al. ..... 173/91
6,799,641 B1 * 10/2004 Lyon et al. ..... 173/17

* cited by examiner

*Primary Examiner*—Rinaldi I. Rada
*Assistant Examiner*—Lindsay Low
(74) *Attorney, Agent, or Firm*—Alix, Yale & Ristas, LLP

(57) ABSTRACT

A sleeve carried by and preferably slidable relative to the piston, for controlling air passages associated with a central air feed tube, whereby retraction pressure is applied to the piston substantially at impact. It is the impact itself of the piston against the bit, which enhances sliding of the sleeve relative to the piston, over the feed tube, and thereby switches the airflow at the moment of impact.

8 Claims, 6 Drawing Sheets

A
B
A
B 12b
12
14
38
20
30
48
22
12a
10
28
S
16
42
24
40
36
34
32
46
18
29
31

16b
14b
16a
26b
26
26a
14a
44
P2
P1

DELAYED COMPRESSION SLEEVE HAMMER

BACKGROUND OF THE INVENTION

The present invention relates to pneumatic hammers, of the type used for boring into earthen formations.

It is common for such hammers to cycle pneumatic pressure to lift a piston within a casing, and aided by gravity, then drive the piston downward against a bit, which breaks up earthen material to be dislodged and removed from the borehole. In general, valving or porting are used to switch the location of the pneumatic pressure between the retraction phase and the actuation or drive phase of the piston. In order to increase the impacts per unit time, efforts have been made to begin establishing retraction pressure before impact in the actuation phase. Unfortunately, this decreases to some extent the force of impact inasmuch as the initial ramping of the backpressure for retraction counteracts the pneumatic drive pressure applied to the impact.

SUMMARY OF THE INVENTION

With the present invention, a sliding valve, preferably a sleeve, reciprocates axially within the piston while surrounding an air supply port in a stationary air feed tube. In this manner, advantage can be taken of passively controlling the position of the sleeve relative to the feed tube and the piston to provide a change in pneumatic air at precisely the moment of impact. This porting delays the compression of the front chamber for retraction of the piston until at or immediately after the piston impacts the bit.

The main concept of the invention can thus be considered as the use of a sleeve carried by and preferably slidable relative to the piston, for controlling air passages associated with a central air feed tube, whereby retraction pressure is applied to the piston substantially at impact. Moreover, it is the impact itself of the piston against the bit, which enhances sliding of the sleeve relative to the piston, over the feed tube, and thereby switches the airflow at the moment of impact.

In a method embodiment, the key steps include positioning a control valve carried by the piston to one limit relative to the piston, for delivering a pneumatic pressure to lift the piston in a retraction phase, upon impact against the bit. Before impact, the control valve is positioned at another limit relative to the piston, for delivering a pneumatic pressure to drive the piston toward the bit in an actuation phase. The impact passively repositions the control valve to initiate the retraction phase.

In an apparatus embodiment, the key features include an air feed passage extending into the piston, a feed port associated with the air feed passage in the piston and remaining within the piston as the piston cycles between the actuation and retraction phases, air delivery passages alignable between the feed port and the front chamber, and a valve for the port in the form of a sleeve slidable between back and front limit positions within the piston. When the piston is advancing toward the bit during the actuation phase the sleeve is at the back limit position, but when the piston impacts the bit the sleeve slides to the front limit position, opening the port and thereby delivering pneumatic pressure from the air feed passage through the air delivery passages to the front air chamber for initiating the retraction phase.

In the preferred embodiment, the feed tube is a cylinder having a closed end mounted for relative axial movement within the piston, and the feed port is defined by at least one aperture in the cylinder wall adjacent the closed end. The piston has an open bottom that extends axially as a central air chamber to the closed end of the feed tube. When the piston is in contact with the bit, the back air chamber supply path in the piston intersects the central air chamber in front of the feed tube without intersecting the feed port. When the piston is in the retracted position to begin the actuation phase the back air chamber supply path intersects the feed port without intersecting the central air chamber. While the piston is moving during the retraction phase from contact with the bit toward the retracted position, the closed end of the feed tube prevents delivery of pneumatic pressure in the central chamber to the back air chamber. The air delivery passage leading from the feed port to the front chamber includes a portion that always confronts the feed tube, but is exposed to pneumatic pressure for retraction, under the control of the sliding sleeve.

BRIEF DESCRIPTION OF THE DRAWING

The preferred embodiments will be described in detail below with reference to the accompanying drawing, in which.

DETAILED DESCRIPTION

Figures 1A, 1B, 1C:
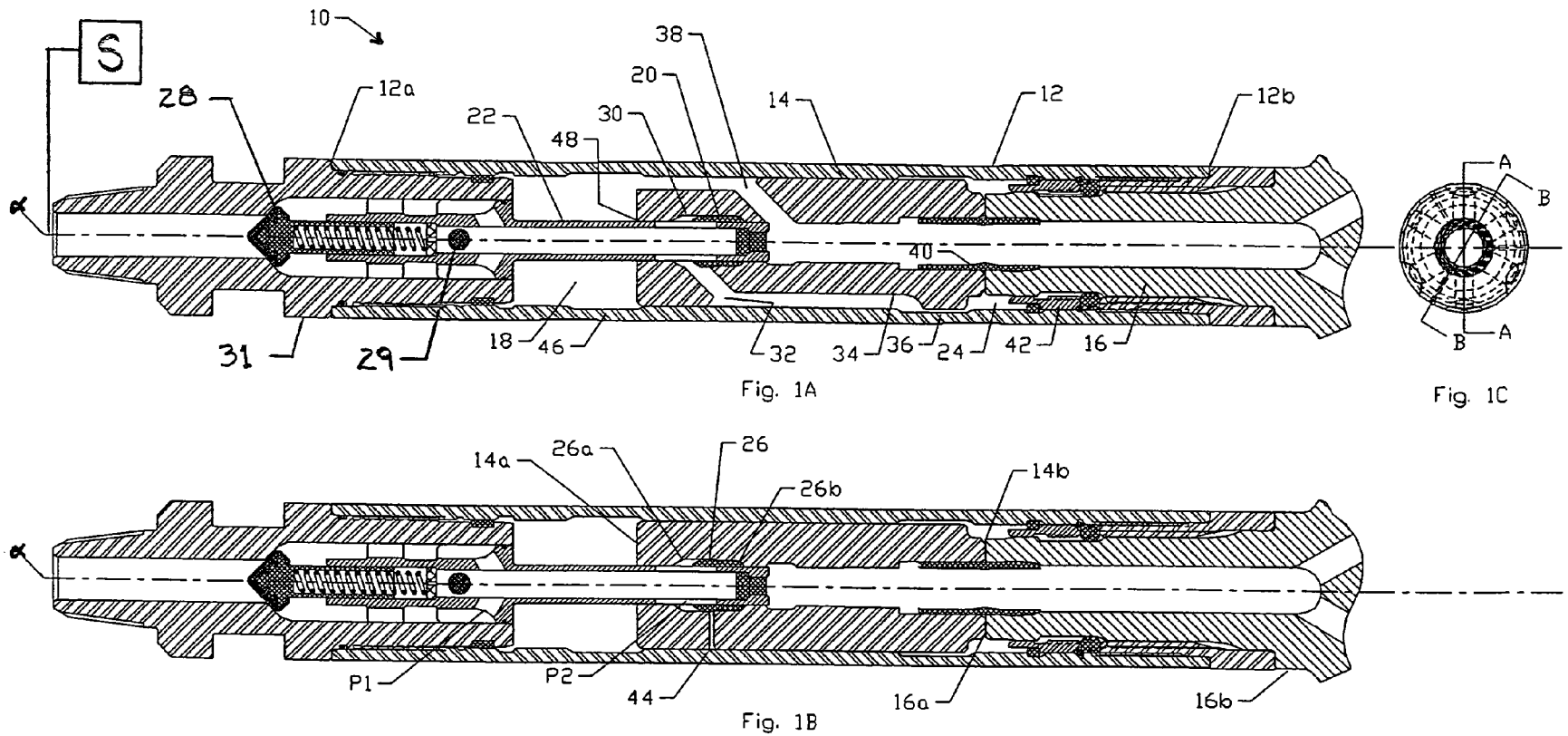
FIGS. 1A and 1B are longitudinal section views of a first embodiment of a hammer according to the invention, along the section lines indicated in FIG. 1C, showing the positions of the moving parts during an infinitesimally short time interval at the end of one hammer cycle and the beginning of the next hammer cycle, when the piston is in contact with the bit.
FIG. 1C is cross section view of the hammer of FIG. 1, showing where the longitudinal section lines have been taken in the other figures.

The preferred embodiment will be described with reference to FIGS. 1-6. Each of FIGS. 1-6 has an A and B section, which are indicated in FIG. 1C. Two section views of the piston at a particular point in the hammer cycle are needed to see the transfer of air in relation to the position of the piston and associated air chambers and ports. An overview description will be followed by a more detailed description.

The hammer 10 comprises a substantially tubular case or casing 12 having upper and lower ends 12*a*, 12*b* extending along a longitudinal axis $\alpha$, along which the actuating or drive piston 14 reciprocates for repeated cycles of impact, retraction, and impact against a bit 16 that is supported in part within the casing and extends in part from the lower end of the casing. In the figures, the hammer is oriented from left to right, but it should be appreciated that in use, the bit 16 at the right projects downwardly into the bore hole and thus in this description references to "top and bottom" or "up and down" or "back and front" mean "left and right" in the figures, respectively. Pneumatic pressure is supplied by a source S above the hammer, and ported through the upper end of the hammer in a conventional manner into top or back air chamber 18, above piston 14.

A sliding sleeve 20 reciprocates axially within the piston 14 while surrounding a stationary air feed tube 22 that is fixed on the hammer axis, and has a closed front end. Pneumatic pressure is supplied to the tube 22 through check valve 28 and via port P1, and is delivered by the tube via port P2 through passages to be described more fully below, to the front or bottom air chamber 24. The check valve 28 is mounted in a counterbore in the feed tube 22 above the pin 29 that attaches the feed tube to the backhead 31. The check valve closes off the central passage of the feed tube so the supply air is routed around the outside of the section, through scallops, into the angled ports P1. Alternating the pressurization of the upper chamber 18 and the lower chamber 24 produces alternation of the actuation or driving phase and the lifting or retraction phase, respectively.

It can thus be appreciated that the position of the sleeve 20 relative to the port P2 of feed tube 22 depends on the movement of the piston 14, and thereby provides a change in pneumatic air path depending on the axial position of the piston. This porting delays the compression of the front chamber 24 for retraction of the piston until at or immediately after the piston 14 impacts the bit 16. Moreover, as will be described more fully below, it is the impact itself of the piston 14 against the bit 16, which enhances sliding of the sleeve 20 relative to the piston, over the feed tube 22 and thereby switches the airflow through port P2.

At a moment shortly following impact, as shown in FIG. 1, the sliding valve sleeve 20 is in its relatively forward position within the back bore 26 formed on the axis through the back end 14*a* of piston 14. This bore 26 can be considered a chamber for sleeve 20. The air feed tube 22 extends longitudinally along the axis into the chamber 26 such that the piston can reciprocate along the feed tube while feed port P2 in the wall of the air feed tube remains within the chamber as the piston cycles between the actuation and retraction phases. The sleeve 20 is of lesser axial extent than the chamber 26, and slidable between back and front stop limits 26*a*, 26*b*. With the sleeve 20 at the front limit 26*b* as shown in FIG. 1, a space 30 is formed at the back of chamber 26 between the sleeve 20 and the back stop 26*a*. In this way, air pressure in tube 22 can pass through the space 30 and port P2 into passage 32, through fluted cut 34, front chamber undercut 36, to the lower chamber 24 and thereby begin the retraction phase of operation.

Figure 3A:
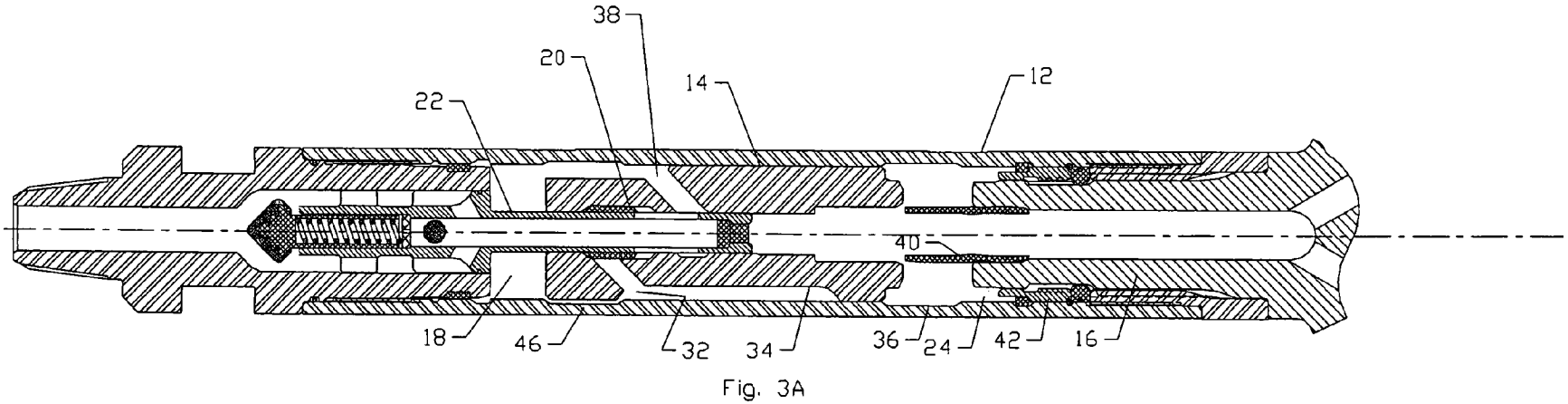
FIGS. 3A and 3B are section views corresponding to FIGS. 1A and 1B, at a point in the hammer cycle when air is exhausted from the front chamber as the piston continues to retract toward the back chamber.
Figure 3B:
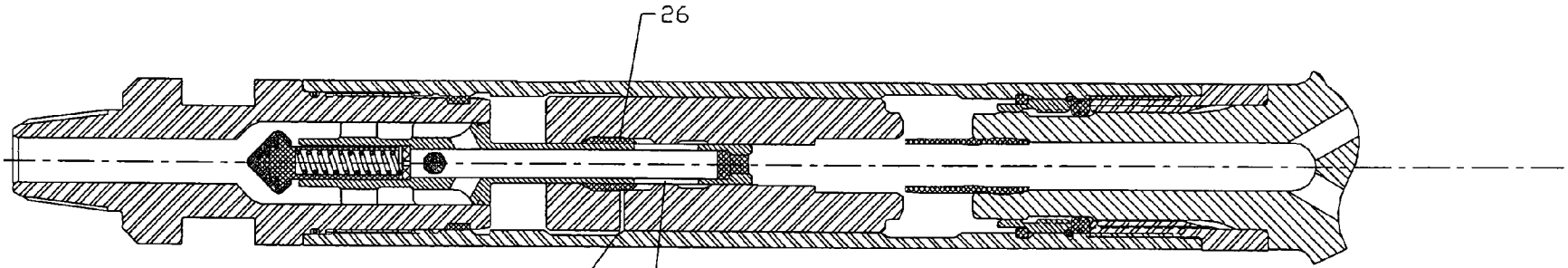

At a later point in the cycle, as shown in FIG. 3, the sliding sleeve 20 has shifted into contact with the back stop 26*a*, thereby sealing off air flow to passage 32, and at the same time permitting air flow from tube 22 into back air chamber supply hole 38 in piston 14, to begin pressurizing of chamber 18 preparatory to the impact phase. The sliding sleeve 20 has created a front space to front stop 26*b*, but this is not used for flow purposes to other passages. Just before impact and at the moment of impact shown in FIGS. 5 and 6, the sliding sleeve 20 has not yet shifted forwardly but, as shown in FIG. 1, the impact immediately shifts sleeve 20 forward to expose the feed tube supply to passage 32 for pressurizing chamber 24 to begin the return or retraction stroke. The impact of the lower or front end 14*b* of the piston against the upper end 16*a* of bit 16 combined with pressurized air from the feed tube ports P1, P2 to the reciprocating sleeve bore chamber 26, causes the reciprocating sleeve 20 to begin moving from the position shown in FIGS. 3-6, to the position shown in FIG. 1, thereby exposing the chamber 24 to pressurized air almost simultaneously at impact or milliseconds thereafter.

One complete cycle of operation will now be described in greater detail. In FIG. 1, the start point of the first hammer cycle, the piston 14 is at rest against the top 16*a* of the bit 16. Before pressurized air is introduced, pressure is equal throughout the hammer. The piston 14 is covering the outside diameter of the exhaust tube 40, which is connected to and projects upwardly from the center of the upper end 16*a* of the bit 16. The outside diameter of piston 14 against the inside diameter of case 12, the outside diameter of the bit bearing 42 against the inside diameter of the case 12, and the inside diameter of the bit bearing 42 against the outside of the upper portion of bit 16 provide seal surfaces for the front air chamber 24 to become pressurized when pressurized air is passed is delivered via feed tube 22.

Figure 2A:
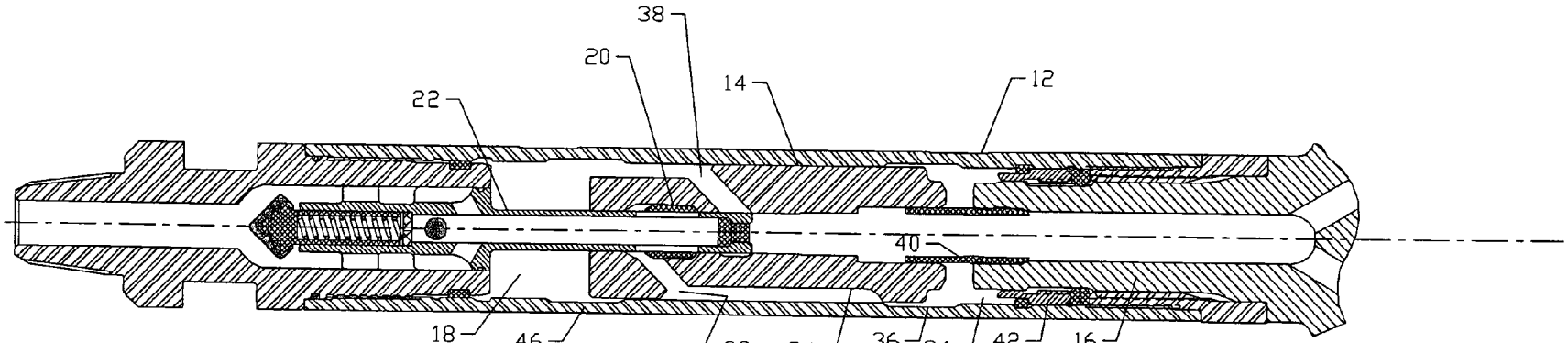
FIGS. 2A and 2B are section views corresponding to FIGS. 1A and 1B, at a point in the hammer cycle when retraction of the piston begins.
Figure 2B:
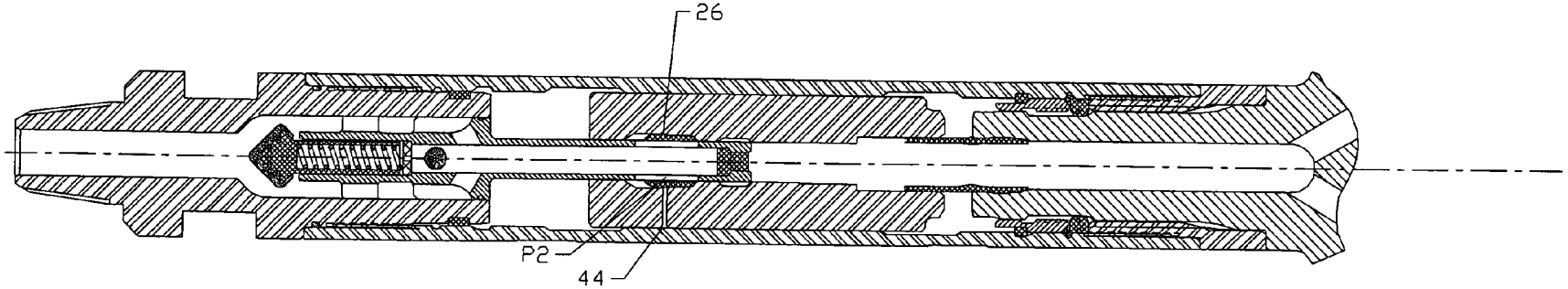

As shown in FIG. 2, as a result of pressurized air passing through the feed tube 22 through the feed tube ports P2, front chamber supply holes 32 along the piston mill cuts 34, and case undercut 36 to the front air chamber 24, the piston 14 begins the retraction displacement. The piston outside diameter cuts 34 become sealed off from the front air chamber 24. As the piston 14 continues to move, the back air chamber supply holes 38 also become sealed by the outside diameter of the feed tube 22 and trapped residual air in the back chamber 18 starts to compress. The reciprocating sleeve activation holes 44 are still sealed by the inside diameter of the case 12 and the outside diameter of the piston 14.

As shown in FIG. 3, the piston 14 now begins to uncover the exhaust tube 40 and air begins to exhaust from the front air chamber 24. At the same time pressurized air is beginning to be supplied to the back air chamber 18 through the feed tube ports P2 and back air chamber supply holes 38. The reciprocating sleeve activation air holes 44 are exposed to the back chamber undercut 46, causing the reciprocating sleeve bore chamber 26 to become pressurized, forcing the sleeve 20 toward the retainer 28. The sleeve 20 is pressed against the shoulder 26*a* of the retainer 28, sealing off the front air chamber air supply holes 32, the piston outside diameter mill cuts 34, the front chamber undercuts 36, and the front chamber 24.

Figure 4A:
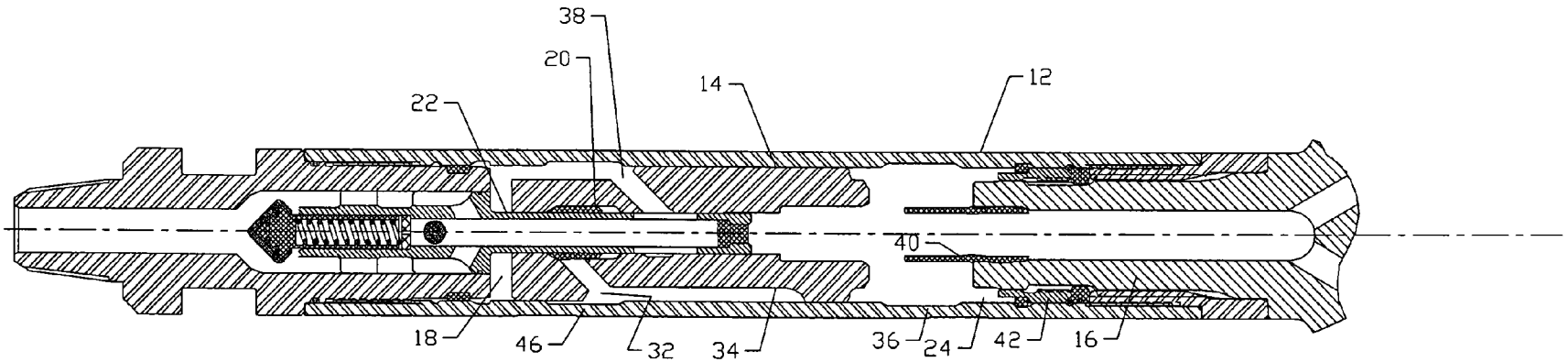
FIGS. 4A and 4B are section views corresponding to FIGS. 1A and 1B, at a point in the hammer cycle when the retraction is substantially complete and the back chamber is pressurized in preparation for the drive stroke.
Figure 4B:
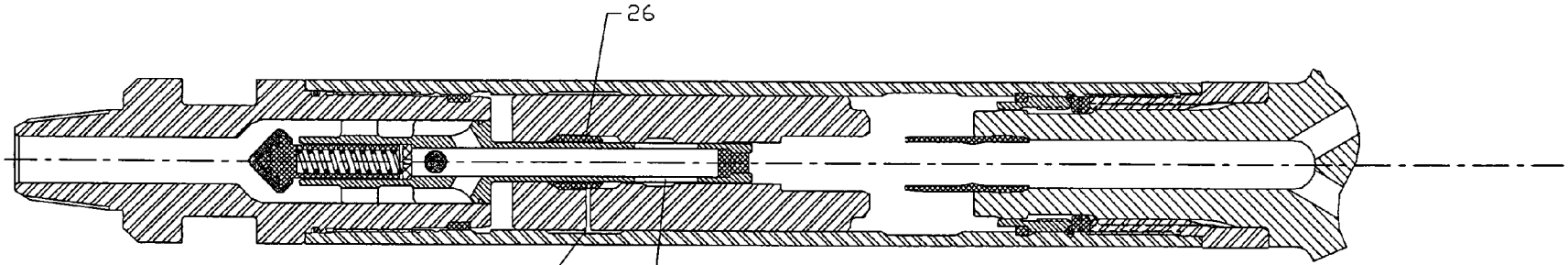

At the moment shown in FIG. 4, the front air chamber 24 is fully exhausted. The sleeve bore chamber 26 is continuously pressurized and air flow to the front air chamber 24 is sealed off by the sleeve 20. The back chamber air supply holes 38 are fully exposed to the feed tube ports P and the piston begins to move in the opposite direction.

Figure 5A:
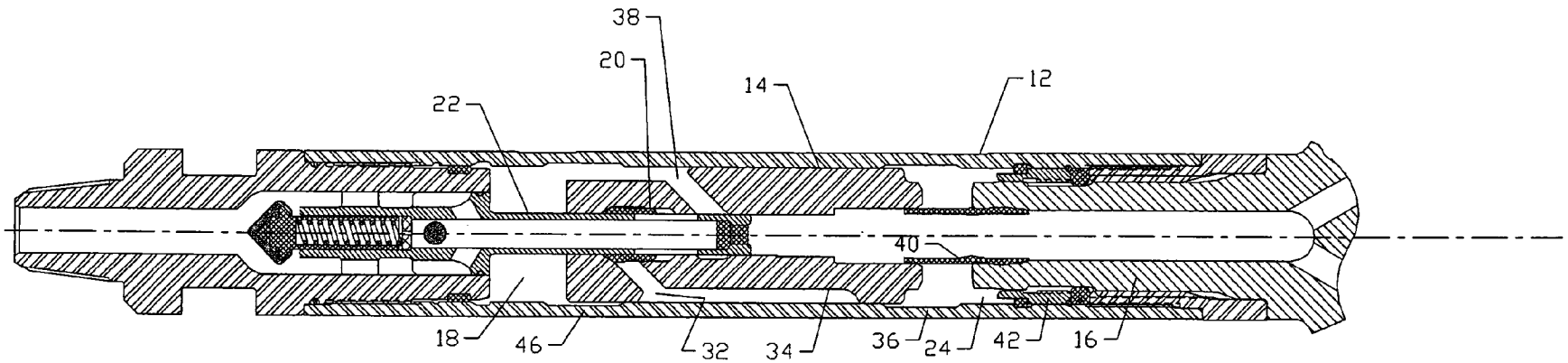
FIGS. 5A and 5B are section views corresponding to FIGS. 1A and 1B, at a point in the hammer cycle when the piston is being driven toward the bit.
Figure 5B:
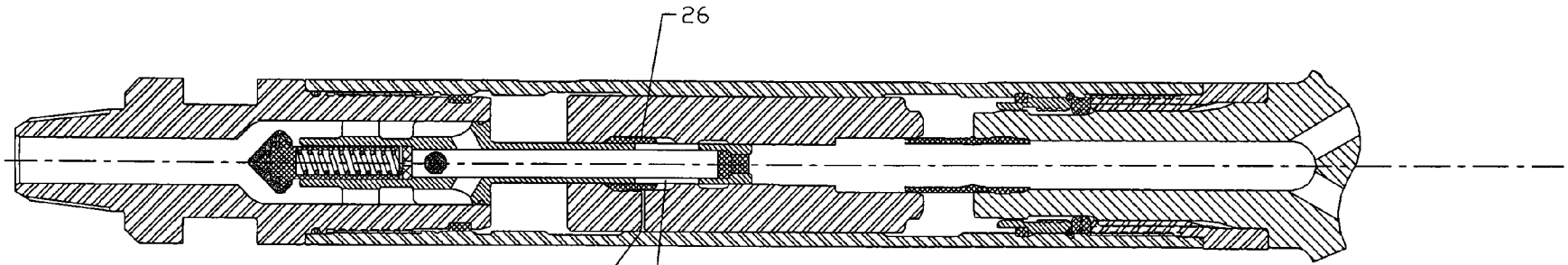

According to FIG. 5 the piston is beginning to cover the exhaust tube 40 and trapped residual air begins to pressurize. The reciprocating sleeve activation holes 44 are now sealed by the inside diameter of case 12 and the outside diameter of piston 14. The pressurized air transmitted through the feed tube ports P to the reciprocating sleeve bore chamber 26 as well as air trapped by sealing off the reciprocating sleeve activation holes 44 keeps the reciprocating sleeve 20 against the stop limit 26*a* of the retainer. This restricts pressurized air from transmitting through the front air chamber supply holes 32, piston outside diameter mill cuts 34, front chamber undercut 36, to the front air chamber 24. Also, the back air chamber 18 has become shut off from pressurized air as the back air chamber supply holes 38 are separated from the feed tube ports P.

Figures 6A, 6B:
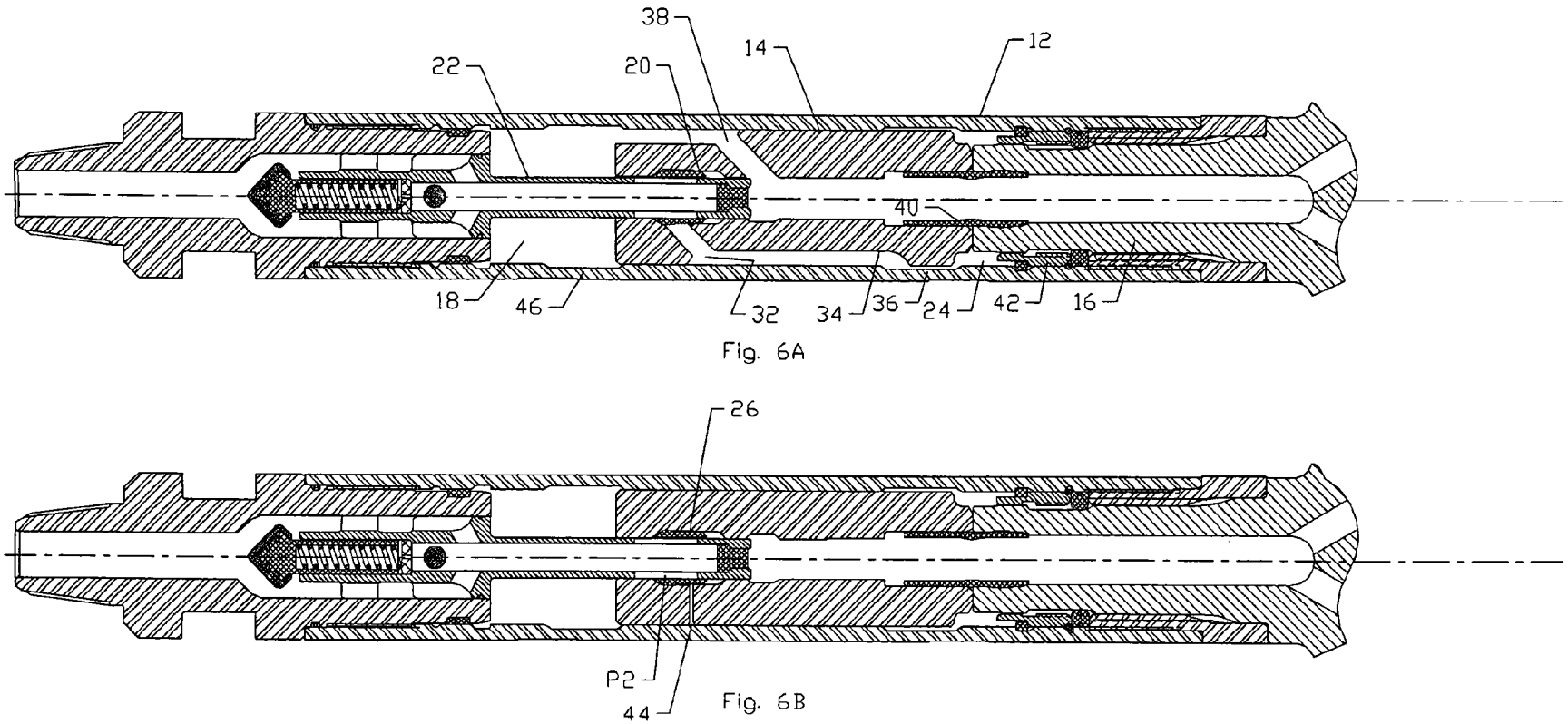
FIGS. 6A and 6B are section views corresponding to FIGS. 1A and 1B, showing the positions of the moving parts during an infinitesimally short time interval immediately before the condition shown in FIG. 1.

As shown in FIG. 6, followed by FIG. 1, the piston 14 has impacted the bit 16 and, combined with pressurized air from the feed tube ports P to the reciprocating sleeve bore chamber 26, has caused the reciprocating sleeve 20 to begin to move.

This has exposed the front air chamber supply holes 32, piston outside diameter mill cuts 34, front chamber undercut 36, and front air chamber 24 to the pressurized air almost simultaneously at impact or milliseconds later. The back air supply holes 38 now exhaust the back air chamber 18, and a new cycle begins.

It can be appreciated that the chamber 26 preferably has a cylindrical center region of greater axial length than the sleeve 20, and the end walls 26*a*, and 26*b* are tapered toward the axis. The sleeve 20 also cylindrical, with front and back ends that taper toward the axis at the same angle as the taper on the chamber end walls.

The invention claimed is:

1. In a pneumatic percussion hammer of the type having:

a substantially tubular casing having upper and lower ends, defining a longitudinal axis;

an actuating piston having upper and lower ends, and supported within the casing for reciprocal motion along the axis;

a bit having an upper end supported within the casing and confronting the lower end of the piston and a lower end extending from the lower end of the casing;

a back air chamber in the casing above the piston and a front air chamber in the casing between the lower end of the piston and the upper end of the bit;

a pneumatic air supply and associated passages and porting, to alternatively impose a high pneumatic drive pressure in the back air chamber against the upper end of the piston, thereby driving the piston downwardly in an actuation phase into impact on the bit, followed by a high pneumatic pressure in the front air chamber against the lower end of the piston, thereby separating the piston from the bit in a retraction phase;

the improvement wherein said passages and porting comprise:

a tubular air feed passage extending into the piston;

a feed port associated with the air feed passage in the piston and remaining within the piston as the piston cycles between the actuation and retraction phases;

air delivery passages alignable between the feed port and the front air chamber; and a valve for the feed port in the form of a sleeve slidable around the air feed passage between back and front limit positions within the piston;

wherein the air feed passage is a tube having a closed end, mounted for relative axial movement within the piston; and the feed port is defined by at least one aperture in the tube wall adjacent the closed end;

whereby while the piston is advancing toward the bit during the actuation phase the sleeve is at the back limit position, closing said feed port, and when the piston impacts the bit said sleeve slides to the front limit position, opening said feed port and thereby delivering pneumatic pressure from the air feed passage through the air delivery passages to the front air chamber to initiate the retraction phase.

2. The pneumatic percussion hammer of claim 1, wherein the piston has an open bottom that extends axially as a central air chamber to the closed end of the feed tube;

when the piston is in contact with the bit, the pneumatic air supply and associated passages provide a back air chamber supply path in the piston that intersects the central air chamber in front of the feed tube without intersecting the feed port; and when the piston is in the retracted position to begin the actuation phase the back air chamber supply path intersects the feed port without intersecting the central air chamber.

3. The pneumatic percussion hammer of claim 2, wherein the air delivery passage leading from the feed port to the front chamber includes a portion that always confronts the feed tube.

4. In a pneumatic percussion hammer of the type having:

a substantially tubular casing having upper and lower ends, defining a longitudinal axis;

an actuating piston having upper and lower ends, and supported within the casing for reciprocal motion along the axis;

a bit having an upper end supported within the casing and confronting the lower end of the piston and a lower end extending from the lower end of the casing;

a back air chamber in the casing above the piston and a front air chamber in the casing between the lower end of the piston and the upper end of the bit;

a pneumatic air supply and associated passages and porting, to alternatively impose a high pneumatic drive pressure in the back air chamber against the upper end of the piston, thereby driving the piston downwardly in an actuation phase into impact on the bit, followed by a high pneumatic pressure in the front air chamber against the lower end of the piston, thereby separating the piston from the bit in a retraction phase;

the improvement wherein said passages and porting comprise:

an air feed passage extending into the piston;

a feed port associated with the air feed passage in the piston and remaining within the piston as the piston cycles between the actuation and retraction phases;

air delivery passages alignable between the feed port and the front air chamber; and a valve for the feed port in the form of a sleeve slidable between back and front limit positions within the piston;

whereby while the piston is advancing toward the bit during the actuation phase the sleeve is at the back limit position, closing said feed port, and when the piston impacts the bit said sleeve slides to the front limit position, opening said feed port and thereby delivering pneumatic pressure from the air feed passage through the air delivery passages to the front air chamber to initiate the retraction phase;

and wherein the air feed passage is a tube having a closed end, mounted for relative axial movement within the piston;

the piston has an open bottom that extends axially as a central air chamber to the closed end of the feed tube;

when the piston is in contact with the bit, the back air chamber supply path in the piston intersects the central air chamber in front of the feed tube without intersecting the feed port;

when the piston is in the retracted position the back air chamber supply path intersects the feed port without intersecting the central air chamber; and while the piston is moving during the retraction phase from contact with the bit toward said retracted position, the closed end of the feed tube prevents delivery of pneumatic pressure in the central chamber to the back air chamber.

5. A pneumatic percussion hammer comprising:

a substantially tubular casing having upper and lower ends, defining a longitudinal axis;

an actuating piston having upper and lower ends and supported within the casing for reciprocal motion along the axis;

a bit having an upper end supported within the casing and confronting the lower end of the piston and a lower end extending from the lower end of the casing;

a sealable back air chamber in the casing above the piston and a sealable front air chamber in the casing between the lower end of the piston and the upper end of the bit;

a pneumatic air supply and associated passages and porting, to alternatively impose a high pneumatic drive pressure in the back air chamber against the upper end of the piston, thereby driving the piston downwardly in an actuation phase into impact on the bit, followed by a high pneumatic pressure in the front air chamber against the lower end of the piston, thereby separating the piston from the bit in a retraction phase;

wherein said passages and porting include an air feed tube fixed within the casing above the piston and extending with a closed front end longitudinally along the axis into a back bore chamber in the piston such that the piston can reciprocate along the feed tube;

a feed port in the wall of the air feed tube that is situated within the piston back bore chamber as the piston transitions from the actuation to the retraction phase;

air passages in the piston extending from the back bore chamber to the front air chamber;

a valve for the port in the form of a substantially tubular sliding sleeve around the feed tube within the piston back bore chamber, having a lesser axial extent than the back bore chamber;

said back bore chamber having back and front limit stops for defining back and front limit positions of said sliding sleeve, wherein the back limit position closes said port and the front limit position opens said port as the piston transitions from the actuation to the retraction phase;

whereby when the piston is advancing toward the bit during the actuation phase the sleeve is at the back limit position, closing said air passages leading from the back bore chamber to the front air chamber, and when the piston impacts the bit said sleeve slides within the back bore chamber to the front limit position, opening said port and thereby delivering pneumatic pressure from the feed tube through the back bore chamber and air passages to the front air chamber to initiate the retraction phase.

6. The pneumatic percussion hammer of claim 5, wherein the feed port is defined by at least one aperture in the tube wall adjacent the closed end.

7. The pneumatic percussion hammer of claim 6, wherein the piston has an open bottom that extends axially as a central air chamber to the closed end of the feed tube;

when the piston is in contact with the bit, the back air is in fluid communication with the central air chamber in front of the feed tube without intersecting the feed port; and when the piston is in the retracted position to begin the actuation phase the back air chamber is in fluid communication with the feed port without intersecting the central air chamber.

8. The pneumatic percussion hammer of claim 7, wherein the air passage leading from the feed port to the front chamber includes a portion that always confronts the feed tube.

* * * * *